United States Patent [19]

Rodgers, Jr.

[11] Patent Number: 4,900,013

[45] **Date of Patent: * Feb. 13, 1990**

[54] EXERCISE APPARATUS

[76] Inventor: Robert E. Rodgers, Jr., 8011 Meadow Croft, Houston, Tex. 77063

[ * ] Notice: The portion of the term of this patent subsequent to Jul. 14, 2004 has been disclaimed.

[21] Appl. No.: 149,173

[22] Filed: Jan. 27, 1988

[51] Int. Cl.[4] ..... A63B 21/00; A63B 1/00

[52] U.S. Cl. ..... 272/70; 272/97; 272/69; 272/72

[58] Field of Search ..... 272/70, 70 A, 69, 72, 272/71, 93, 97, 134, DIG. 2, 126, 132; 104/106, 107, 108, 109, 110, 111; 128/25 R, 25 B

[56] References Cited

U.S. PATENT DOCUMENTS

| | | | |
|---|---|---|---|
| 2,614,609 | 10/1952 | Denison | 272/70 |
| 2,646,282 | 7/1953 | Ringman | 272/70 |
| 2,772,881 | 12/1956 | Fundom | 128/25 R |
| 3,582,069 | 6/1971 | Flick | 272/70 |
| 4,340,214 | 7/1982 | Schutzer | 272/130 |
| 4,679,786 | 7/1987 | Rodgers | 272/97 |
| 4,709,918 | 12/1987 | Grinblat | 272/70 |

*Primary Examiner*—Stephen R. Crow
*Attorney, Agent, or Firm*—Gunn, Lee & Miller

[57] ABSTRACT

An improved exercise apparatus, having two rails in parallel relation supported on a frame. Supported internally to each rail are two travellers, the four travellers for engagement with the limbs of the user. Each pair of travellers is supported internally to the rail one above the other, with the bottom travellers extending outwardly beyond the sides of the apparatus. The travellers ride within grooves in the rails. Also supported within each rail is an endless chain means. When the travellers are coupled to the endless chain means, the user encounters a resistive force from a force resistance system. Each set of travellers is selectively coupled to the respective endless chain means.

28 Claims, 11 Drawing Sheets

EXERCISE APPARATUS

FIELD OF THE INVENTION

This invention is an improvement to my U.S. Pat. No. 4,679,786, UNIVERSAL EXERCISE MACHINE, issued July 14, 1987. The improved exercise apparatus of the present invention may be used for any number of of different types of exercises, is more compactly structured than prior apparatus, and has an improved drive system and a force resistance system.

BACKGROUND OF THE INVENTION

In my U.S. Pat. No. 4,679,786, UNIVERSAL EXERCISE MACHINE, issued July 14, 1987, I disclose as a preferred embodiment of an exercise machine a track-operated multi-pedal apparatus having four moving slides, each slide for operative connection to one of the limbs of the user. There are two endless chain means which travel in loops, each of the chain means selectively coupled to two of the slides. The endless chain means, which are driven by the slides during limb exercise by the user, are operatively connected to a flywheel which provides a resistance to the user during limb exercise.

Examples of other exercise devices of interest having movable slides or the like for operable connection to the limbs include U.S. Pat. No. 3,941,377 to Lie, issued March 2, 1976; U.S. Pat. No. 4,529,194 to Haaheim, issued July 16, 1985; and U.S. Pat. No. 4,618,139 to Haaheim, issued October 21, 1986.

SUMMARY OF THE INVENTION

One aspect of the present invention is an improved exercise apparatus having a rail mounted on a frame and two travellers supported internally to the rail, one above the other, the travellers adapted to engage the limbs of a user during exercise. The apparatus includes an endless chain means coupled to the travellers, a force resisting means, and connecting means for connecting the endless chain means to the force resisting means.

In a preferred embodiment, the apparatus has two rails, each rail having two travellers supported internally thereto. There are two endless chain means, one supported within each rail. Each pair of travellers is selectively coupled to one or the other of the endless chain means. Also included in the preferred embodiment is a force resisting means and connecting means for connecting the endless chain means to the force resisting means.

Another aspect of the invention is a force resistance system for an exercise apparatus. The force resistance system includes a torque arm mounted on a first shaft, the first shaft being supported in the exercise apparatus and operatively connected to limb engaging means on the apparatus. A secondary arm, which is mounted on a second shaft supported in the apparatus, is attached at a first end to a first end of the torque arm. A follower, such as a roller supported on a fixed surface of the apparatus, is mounted to the first end of the secondary arm. A brake system applies a braking force to the second end of the torque arm, causing the torque arm to pivot on the first shaft, the secondary arm to pivot on the second shaft, and the roller to act as a follower and move on the fixed surface in response to the pivoting action of the secondary arm. Once the system reaches equilibrium, the user encounters the braking force when attempting to move the limb engaging means. An angle between the secondary arm and the torque arm at equilibrium is proportional to the braking force. Means are also provided to measure the angle between the secondary arm and the torque arm.

DETAILED DESCRIPTION

Figure 1:
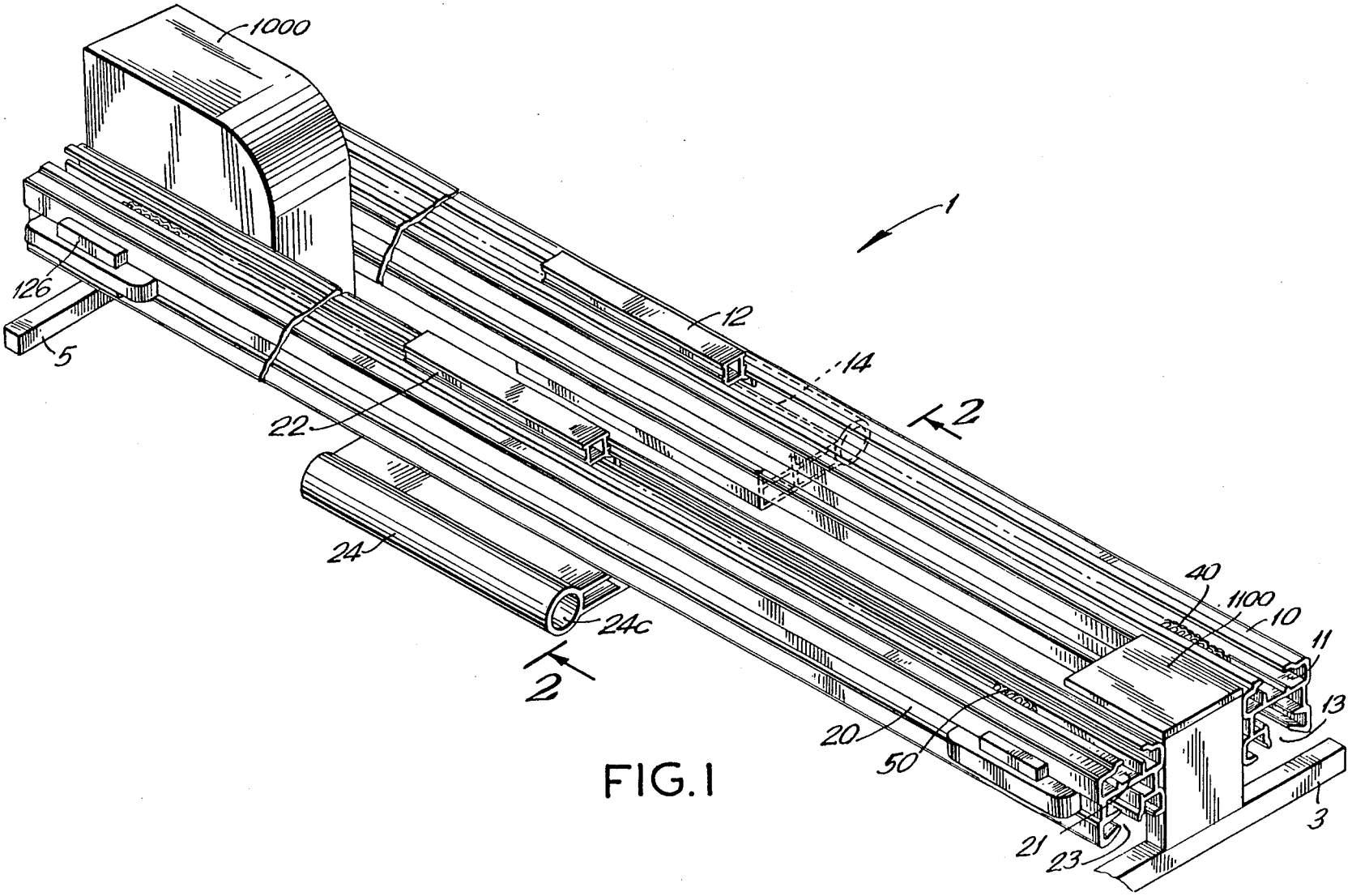
FIG. 1 is an isometric view of an exercise apparatus of the present invention, the apparatus having two rails and a top and bottom traveller supported internally to each rail, the travellers for engaging the limbs of a user during exercise.

An improved exercise apparatus 1 shown in FIG. 1 may be used for any number of different modes of limb exercise or limb physical therapy and rehabilitation. The apparatus can change its shape to accommodate numerous aerobic and fitness activities. For example, the apparatus 1 may be configured to allow the user to engage in so-called recumbent quadrilateral exercise. Generally, recumbent exercise is when the user engages in reciprocating foot and hand motion while in a seated or reclining position. This provides exercise of muscles in the legs, back, shoulders, arms and torso. It is possible on this apparatus, when in this mode, to exercise arms and legs together, legs only, or arms only, or any combination of arms and legs. The leg motion in this type of exercise can best be compared to pedaling a bicycle. In recumbent quadrilateral exercise, all four limbs engage in the exercise procedure.

The improved exercise apparatus 1 may be used in a rowing mode, where the user grasps handles on the apparatus and engages in a rowing-type motion with his arms. In the rowing mode, the user's arms engage in synchronized motion rather than reciprocating motion. A seat slides on the apparatus as the user's arms engage in synchronized motion during the rowing mode.

The apparatus 1 may also be used as a ski trainer, particularly for simulating cross-country skiing where the user engages in reciprocating foot motion to simulate the walking action of cross-country skiing. Since the ski poles and footplates which simulate skis are interconnected, as described below, skiing motion is naturally coordinated. In the skiing mode, simulated ski poles with telescoping action are provided to give the user arm exercise which approximates actual cross-country skiing conditions.

The apparatus can also be configured to provide passive ranging for the user's limbs for physical therapy purposes. Passive ranging involves carrying the user's limb or limbs through a specified range of motion, for instance by driving a foot pedal or a handle with a motor or some other drive means. During passive ranging, the user need not exert any force with his limbs to cause movement of a foot pedal or handle attached to the apparatus.

As described below, the exercise apparatus 1 may be used in any of the above-identified modes, as well as numerous other configurations.

Figure 11:
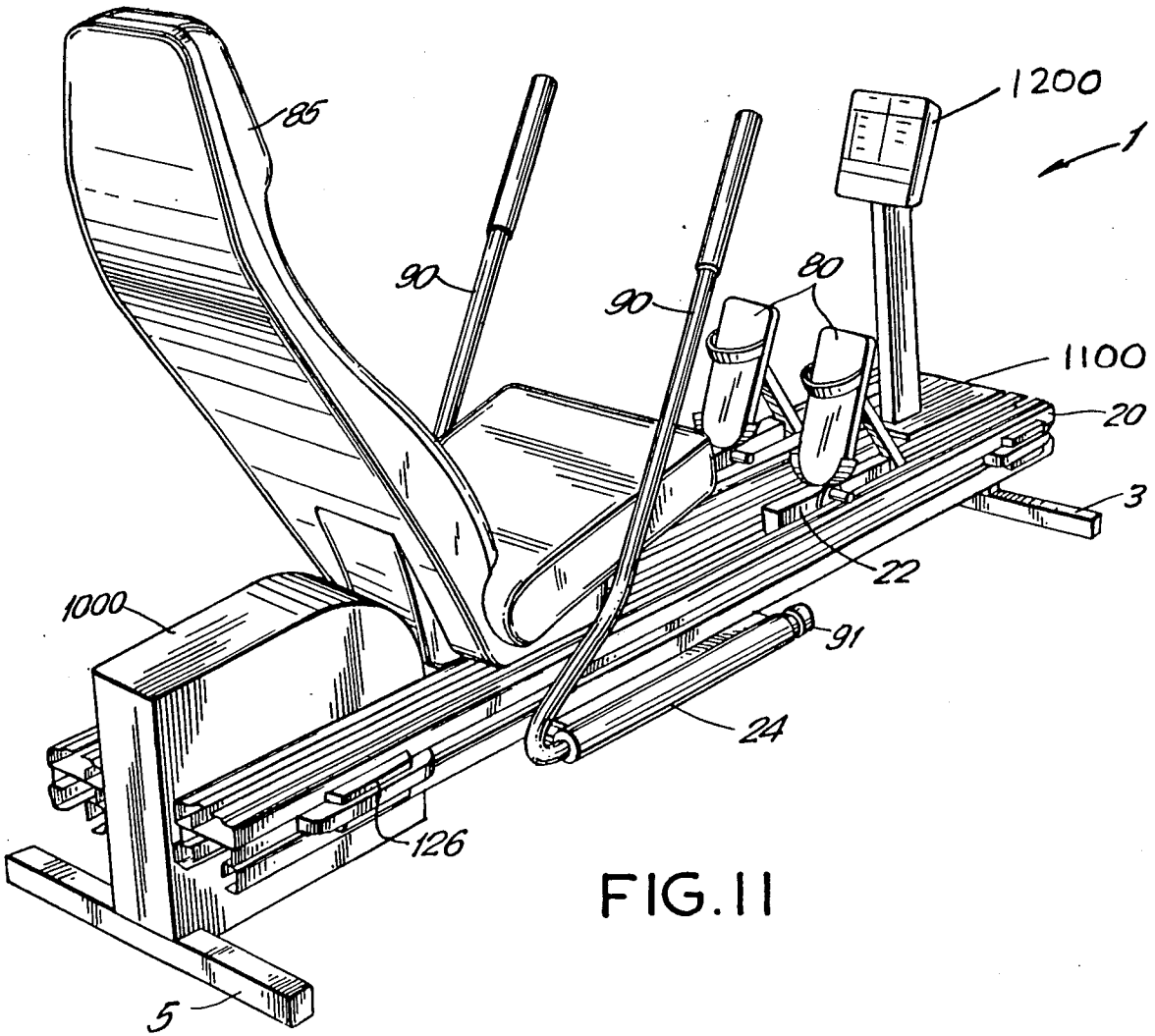
FIG. 11 is an isometric view of the exercise apparatus with a seat, two handles attached to the bottom travellers and two foot pedals attached to the upper travellers, the apparatus shown being suitable for use in a recumbent exercise mode.

FIGS. 1 and 11 are isometric views of an improved exercise apparatus 1. There are two T-shaped supportive frame members 3 and 5 at opposite ends of the apparatus, the bottom portion of each member 3 and 5 resting on the floor. The two frame members 3 and 5 also serve to define the length of the apparatus 1. Rails 10 and 20, which serve to support travellers for engagement with the limbs of the user during exercise, are mounted on and attached to the frame members 3 and 5 by bolts or other suitable attachment means.

Rails 10 and 20 are situated parallel to one another, as seen in the various figures. It is understood that the description of the structure of rail 10 given below applies in mirror-image fashion to rail 20.

Rail 10 supports travellers 12 and 14 for coupling or operable connection to a first endless chain means, for example link chain 40, as seen in FIGS. 2, 4, 5A and 5B, and other figures. Rail 20 supports travellers 22 and 24 for coupling or operable connection to a second endless chain means, for example link chain 50. The four travellers 12, 14, 22 and 24 are designed to be connected operably to the limbs of the user, through pedals, footplates, handles or the like, for any different number of exercise modes or physical therapy modes.

Figure 2:
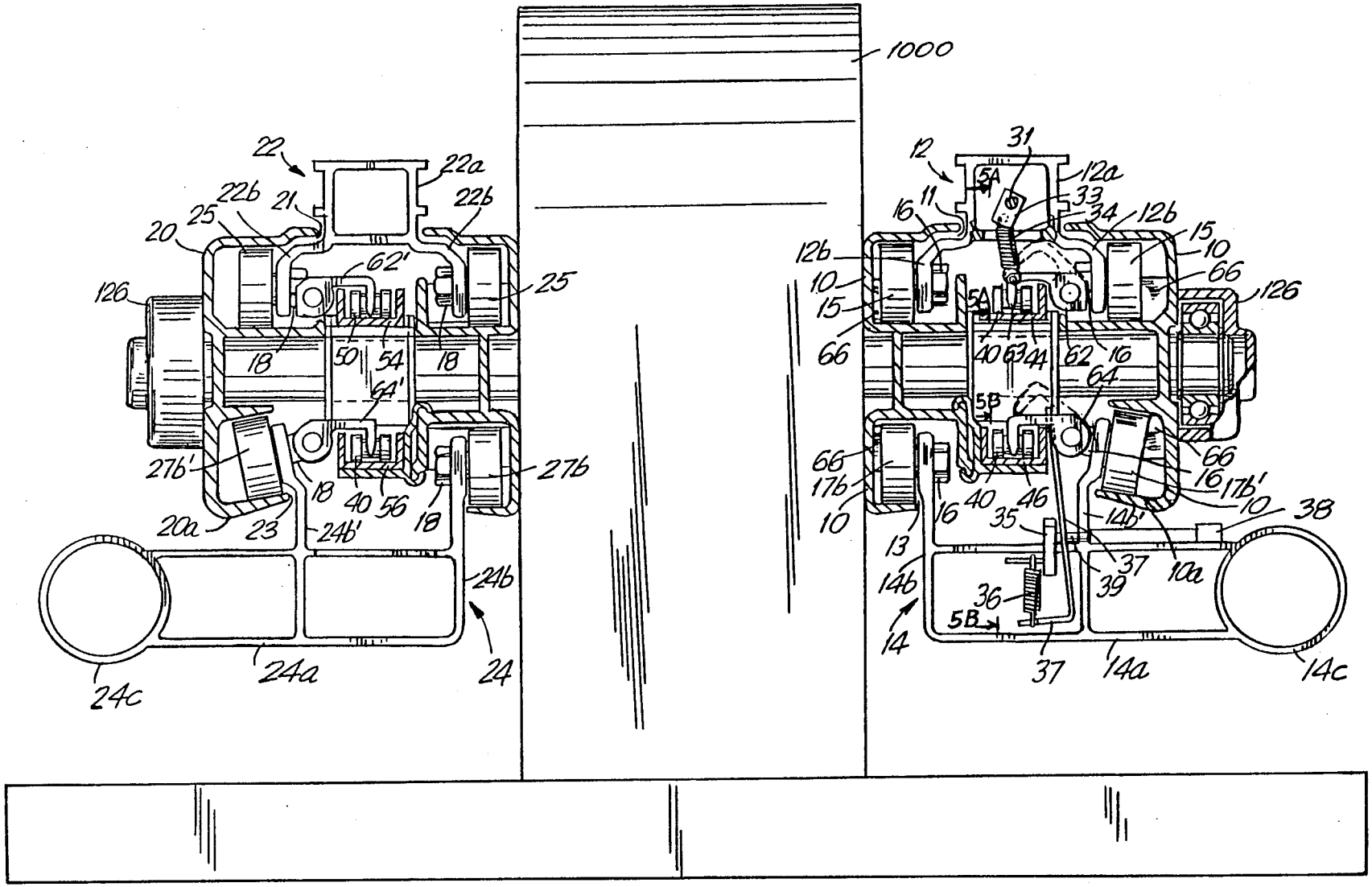
FIG. 2 is an elevational view along lines 2—2 of FIG. 1 showing the arrangement of the rails and the interconnection of the travellers and endless chain means within the rails, as well as other details of the apparatus.

Rail 10 has a top groove 11 and a bottom groove 13, each of which extends through the length of the apparatus 1. Rail 10 has a top opening and a bottom opening, providing access to grooves 11 and 13, respectively, for receipt of travellers 12 and 14 within the grooves 11 and 13, as seen in FIG. 2. Although the grooves 11 and 13 shown in FIG. 2 each have substantially a rectangular cross-section, it is understood that grooves having a different cross-sectional shape could also be used.

Similarly, rail 20 has a top groove 21 and a bottom groove 23, each of which extends through the length of the apparatus 1. Rail 20 has a top opening and a bottom opening, providing access to grooves 21 and 23, respectively, for receipt of travellers 22 and 24 within the grooves 21 and 23, as seen in FIG. 2.

Supported internally to the rail 10 within the top groove 11 is the traveller 12. A bottom traveller 14 is supported internally to the rail 10 within the bottom groove 13 in rail 10. Similarly, top traveller 22 and bottom traveller 24 are supported internally to the rail 20 within grooves 21 and 23 of rail 20, respectively.

The traveller 12 is in the form of an inverted U with a top portion 12*a* having a rectangular cross-section adapted to receive a pedal 80 or the like, as may be seen in FIG. 11. Traveller 12 is supported within groove 11 of rail 10 by two rollers 15, one roller 15 being attached to each of downwardly-extending side walls 12*b* of the traveller 12. The rollers 15 are made, for example, of bearings with nylon tires. Traveller 12 is attached to rollers 15 by, for example, bolts 16, though other attachment means are suitable. The diameter of each roller 15 is slightly less than the height of groove 11, thereby permitting each roller 15, and the traveller 12 which is attached to the rollers 15, to travel almost the entire length of the groove 11 in the rail 10.

The top portion 12*a* of traveller 12 is adapted to receive, as previously stated, the foot pedal 80, shown in FIG. 11. Foot pedal 80 can, for example, press fit or snap onto traveller 12. Foot pedal 80 can also slide over the top portion 12*a* of the traveller 12 and be secured to the traveller 12 in the manner shown in FIG. 12 and described below in conjunction with that figure.

The top portion 12*a* of the traveller 12 extends up out of the top opening of rail 10. This structure permits the traveller 12 to be supported internally to the rail 10 while at the same time providing a means above the rail 10, namely top portion 12*a*, for mounting a pedal or the like on the traveller 10.

Traveller 22 is identical in structure to traveller 12. A top portion 22*a* of traveller 22 is rectangular in cross-section and is adapted to receive a pedal 80 or the like. Traveller 22 is supported within groove 21 of rail 20 by two rollers 25, one roller 25 being attached to each of downwardly-extending side walls 22b of the traveller 22. Bolts 18 may be used to attach the downwardly-extending side walls 22b of the traveller 22 to the rollers 25. The diameter of each roller 25 is slightly less than the height of groove 21, thereby permitting the rollers 25, and the traveller 22 to travel almost the entire length of the groove 21 in the rail 20.

The top portion 22a of traveller 22 is adapted to receive the foot pedal 80. The manner of attachment of foot pedal 80 to the traveller 22 is as described above with regard to the attachment of foot pedal 80 to traveller 12.

The top portion 22a of the traveller 22 extends up out of the top opening of rail 20. This structure permits the traveller 22 to be supported internally to the rail 20 while at the same time providing a means above the rail 20, namely top portion 22a, for mounting a pedal or the like on the traveller 20.

Figure 13:
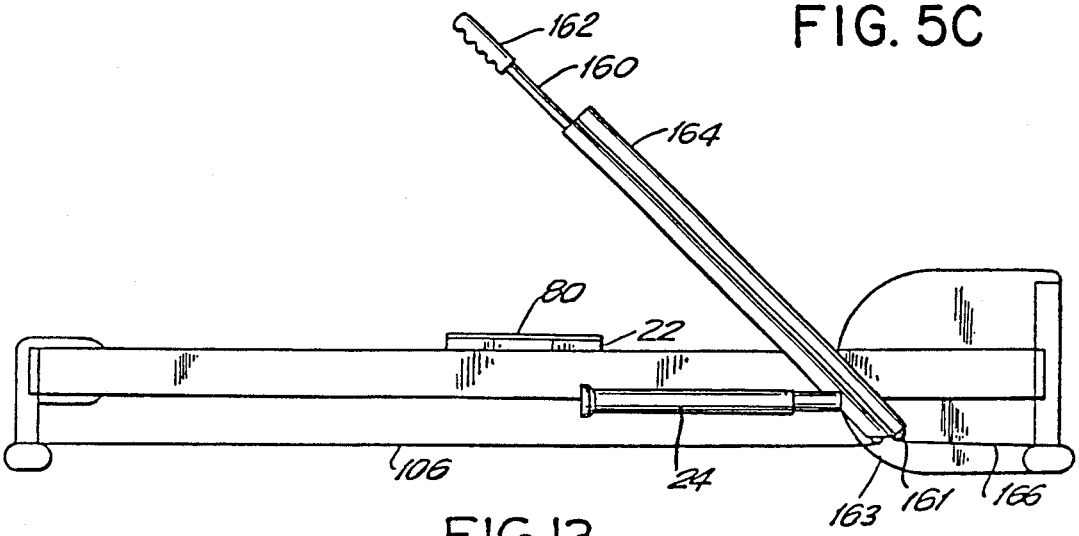
FIG. 13 is a simplified side elevational view of another embodiment of the exercise apparatus configured to simulate skiing motion wherein ski poles attached to the lower travellers of the apparatus are telescoping to more accurately simulate actual ski-pole feel and appearance.

Traveller 14 has upwardly-extending side walls 14b and 14b' which extend into the groove 13. A bottom portion 14a of the traveller 14 extends out of the bottom opening in rail 10 and also extends laterally beyond a side edge of the rail 10, terminating in a radial receiving section 14c. Radial receiving section 14c is adapted to receive, for example, a handle 90 or a ski pole 160, as shown in FIGS. 11 and 13.

Figure 12:
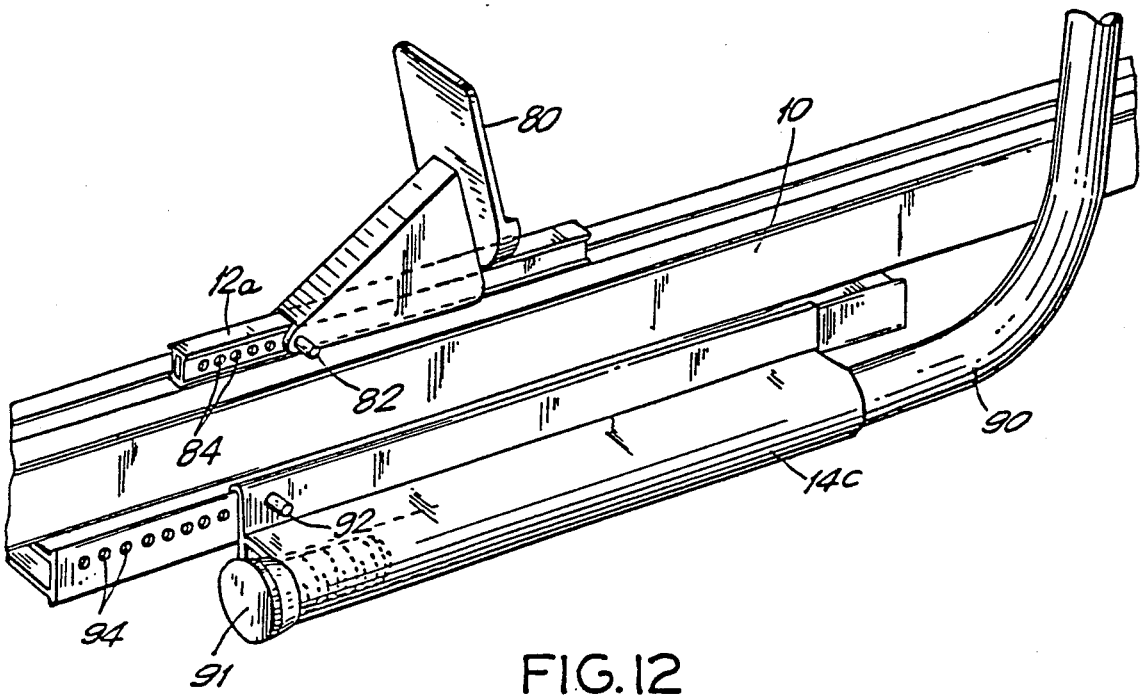
FIG. 12 is a detail view of selective positioning of the handles and pedals relative to the travellers of the apparatus.

Any suitable manner of attachment of the handle 90 or the ski pole 160 to the radial receiving section 14c may be used, for example a threaded knob 91 as shown in FIGS. 11 and 12.

The traveller 14 is supported within the groove 13 of rail 10 by rollers 17b and 17b'. Each upwardly/extending side wall 14b and 14b' of traveller 14 is attached to its respective roller 17b or 17b' by bolts 16, or any other suitable attachment means. The diameter of each roller is slightly less than the height of groove 13, thereby permitting the rollers, and the attached traveller 14, to travel almost the entire length of the groove 13 in the rail 10.

The side wall 14b', at a top portion, is at an angle relative to the frame members 3 and 5 and other vertical elements of the rail 10. The roller 17b' is placed in groove 13 at that same angle. An angled surface 10a of rail 10 is at a 90° angle to the angle of the side wall 14b' to permit the placement of roller 17b' and the attached side wall 14b' in groove 13. This angular displacement of the top portion of the side wall 14b' of the traveller 14 is linear to the grasp point of the handle 90 or the ski pole 160, minimizing side loading in the traveller 14, an important consideration given the elongated shape of the traveller 14.

Slide blocks 66 are attached to travellers 12 and 14 to prevent lateral shifting of those travellers within rail 10. Slide blocks 66 are sufficient to prevent lateral shifting of the travellers 12 and 14 during the exercise procedure because the lateral loads on the travellers 12 and 14 are small compared to vertical loads.

Traveller 24 is identical in structure to traveller 14. Traveller 24 has upwardly-extending side walls 24b and 24b' which extend into the groove 23. A bottom portion 24a of the traveller 24 extends out of the bottom opening in rail 20 and also extends laterally beyond a side edge of the rail 20, terminating in a radial receiving section 24c. Radial receiving section 24c is adapted to receive a handle 90 or a ski pole 160, as shown in FIGS. 11 and 13.

As with traveller 14 and its radial receiving portion 14c, any suitable manner of attachment of the handle 90 or the ski pole 160 to the radial receiving section 24c may be used.

The traveller 24 is supported within the groove 23 of rail 20 by rollers 27b and 27b'. The upwardly-extending side walls 24b and 24b' of traveller 24 are attached to rollers 27b and 27b', respectively, by bolts 18, or any other suitable attachment means. The diameter of each roller is slightly less than the height of groove 23, thereby permitting rollers, and the attached traveller 24, to travel almost the entire length of the groove 23 in the rail 20.

An upper portion of the upwardly-extending side wall 24b' is at an angle relative to the frame members 3 and 5 and other vertical elements of the rail 20. The roller 27b' is placed in groove 23 at that same angle. An angled surface 20a of rail 20 is at a 90° angle to that of the side wall 24b' to permit the placement of roller 27b' and the attached side wall 24b' in groove 23. This angular displacement of the side wall 24b' of the traveller 24 and the roller 27b' is linear to the grasp point of the handle 90 or the ski pole 160, minimizing side loading in the traveller 24, an important consideration given the elongated shape of the traveller 24, as discussed above with regard to traveller 14.

Slide blocks (not shown), attached to travellers 22 and 24, prevent lateral shifting of the travellers 22 and 24 in exactly the same manner slide blocks 66 prevent lateral shifting of travellers 12 and 14.

As is readily seen from the various figures, traveller 12 is located above traveller 14 and traveller 22 is located above traveller 24. Because the bottom portion 14a of the traveller 14 extends outwardly from the rail 10 beyond a side edge of the rail 10, it is possible to support two travellers, such as travellers 12 and 14, on just one rail, such as rail 10. Similarly, rail 20 supports two travellers, namely travellers 22 and 24. Accommodating four travellers on just two rails allows for a simplified apparatus, where all four limbs of a user can be exercised or can engage in physical therapy on the apparatus without the need for four separate rails. Two rails represent a space and cost savings, allow for a simpler construction, and also add to the aesthetic appeal of the apparatus. Given the increased interest today in high quality, compact and inexpensive exercise apparatus for home use, the two-rail construction of the apparatus 1 has many advantages over prior exercise machines.

The simplified structure of two rails each supporting two travellers is possible because the travellers are supported internally to the rails where they can be coupled to the internally mounted link chains which are each deployed in a loop. Mechanical loads are also better balanced when travellers are supported internally to the rails because the point of force application on the pedals and handles is aligned with the traveller coupling points. The internally-supported traveller arrangement also is safer because there are fewer pinch points as the chain, rollers, and coupling points of the traveller are all located within the rails.

Also located within the top groove 11 and the bottom groove 13 of rail 10 is a first endless chain means, for example link chain 40. Link chain 40 is deployed and supported in the form of an endless oval loop by elongate chain tracks 44 and 46, which in turn are attached to the rail 10. Elongate chain tracks 44 and 46 are spaced one above the other as shown in FIG. 2. A second endless chain means, for example link chain 50, is similarly supported in the form of an endless oval loop within rail 20 by elongate chain tracks 54 and 56. Elongate tracks 54 and 56 are fixed to rail 20. The configuration of chain tracks 44 and 46 and 54 and 56 prevents wobble of the link chains 40 and 50 during movement of those chains.

Figure 4:
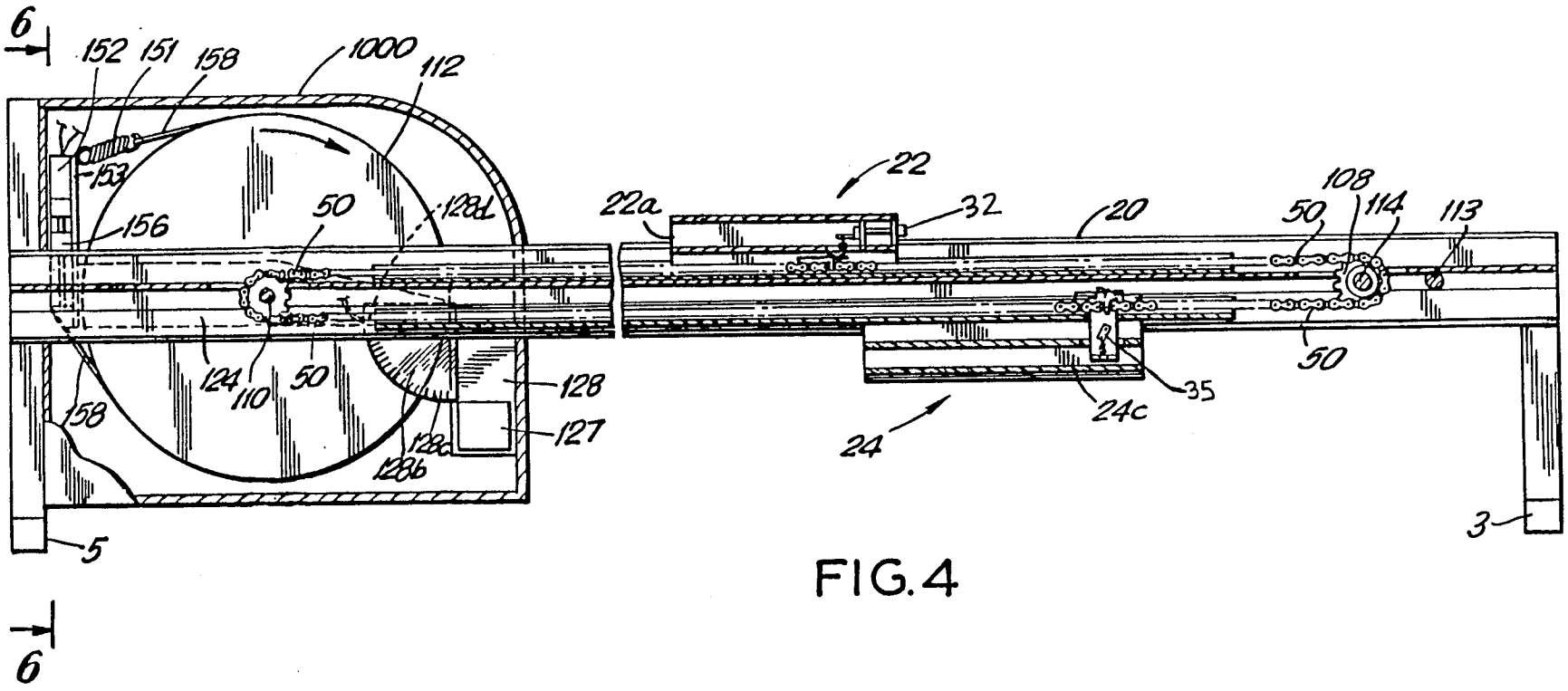
FIG. 4 is an elevational side view in section along lines 4—4 of FIG. 3 showing additional details of the apparatus including portions of the force resistance system.
Figure 5A:
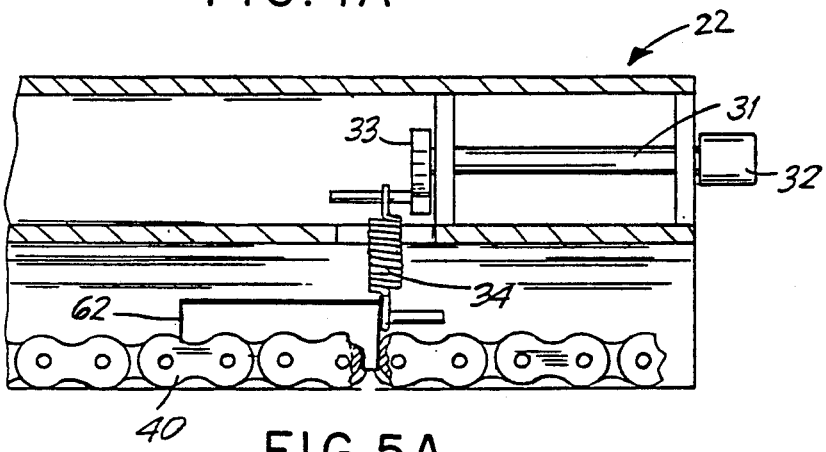
FIG. 5A is an enlarged detailed view of a chain coupler for coupling the upper traveller shown in FIG. 4 to the endless chain means, the chain coupler also being used to selectively release the travellers from the endless chain means.
Figure 5B:
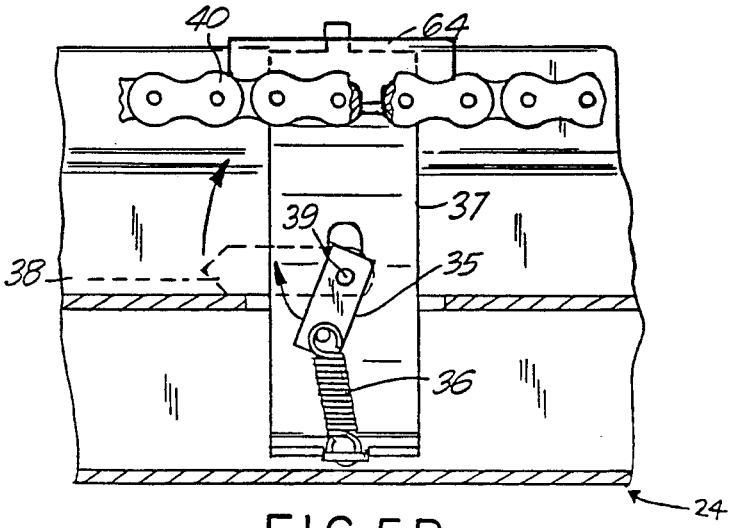
FIG. 5B is an enlarged detailed view of a chain coupler for coupling the bottom traveller shown in FIG. 4 to the endless chain means, the chain coupler also being used to selectively release the traveller from the endless chain means.

The manner of coupling the travellers to the link chains in the preferred embodiment of the exercise apparatus is shown in FIGS. 5A and 5B. Aspects of the coupling means may also be seen in FIGS. 2 and 4.

Chain couplers 62 and 64, operatively connected to travellers 12 and 14, are used to couple those travellers to the link chain 40. When chain coupler 62 is rotated to the down position as shown by solid lines in FIG. 2, the traveller 12 is engaged between the links of the link chain 40. When chain coupler 64 is rotated to the down position as shown by solid lines in FIG. 2, the traveller 14 is engaged between the links of the link chain 40.

The manner of coupling the traveller 12 to the link chain 40 is as follows. Upper lever 33, shown in FIGS. 2 and 5A, is locked to an upper actuating knob 32 through upper knob shaft 31. When the user rotates the upper actuating knob 32 through 180 degrees, the upper lever 33 also rotates 180 degrees. As the lever 33 rotates, a force is applied to the chain coupler 62 through an upper spring 34. As seen in FIGS. 2 and 5A, a first end of the spring 34 is attached to the upper lever 33 and a second end of the spring is attached to the coupler 62. As the coupler 62 rotates out of engagement with the link chain 40, the spring 34 may stretch, thus compensating for misalignment or tolerance accumulations resulting from manufacturing.

In FIG. 2, the coupler 62 is shown in dotted line disengaged from the link chain 40. The lever 33 and spring 34 are shown in solid line only for ease of illustration in FIG. 2. The solid line configuration shows engagement with the link chain 40. The coupler 62 is shown in isolation in FIG. 5C.

Lower lever 35, shown in detail in FIGS. 2 and 5B, operates in the following manner. Lower lever 35 is locked to a lower actuating knob 38 through lower knob shaft 39. When the user rotates the lower actuating knob 38 through 180° degrees, the lower lever 35 also rotates 180° degrees. As the lever 35 rotates, a force is applied to a lower actuating link 37 through a lower spring 36, causing the chain coupler 64 to be disengaged from the link chain 40, as shown by dotted line in FIG. 2. As seen in FIGS. 2 and 5B, a first end of the spring 36 is attached to the lower lever 35 and a second end is attached to the chain coupler 64 through link 37. The lever 35, spring 36 and lever 37 are shown in solid line only for ease of illustration in FIG. 2.

As with the upper lever configuration, the stretching of spring 36 compensates for misalignment or tolerance accumulations resulting from manufacturing. Chain coupler 64 is identical in configuration to coupler 62 which is shown in FIG. 5C.

Chain coupler 62' is coupled to link chain 50 in exactly the same manner as the coupling of coupler 62 to link chain 40 described above. It is understood that these are an upper lever, upper actuating knob, upper knob shaft and upper spring for chain coupler 62' identical to those elements shown in FIGS. 2 and 5A and described above for chain coupler 62.

Similarly, for chain coupler 64', there is identical structure to that shown and described for coupler 64, namely a lower actuating knob, lower knob shaft, lower lever, lower spring and lower actuating link.

Figure 5C:
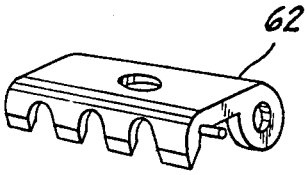
FIG. 5C is an isometric view in isolation of the chain coupler shown in FIGS. 5A and 5B.

It is to be understood that chain couplers 64, 62' and 64' are all identical in configuration to coupler 62 shown in isolation in FIG. 5C.

Coupling of the travellers 12, 14, 22 and 24 to their respective link chains 40 or 50 has the advantages discussed in my U.S. Pat. No. 4,679,786, UNIVERSAL EXERCISE MACHINE, issued July 14, 1987, in the sections referring to connecting one or more of the four slides shown in that patent to the endless chain means, for instance at column 7, lines 1–12, which description is incorporated herein by reference.

For example, in the improved exercise apparatus 1 of the present invention, all four travellers 12, 14, 22 and 24 can be connected to the endless chain means so that the user can provide power through all four travellers. Any one or more of the travellers can be connected to the endless chain means, providing a wide variety of exercise, physical therapy and rehabilitation modes and sequences.

When chain coupler 62 is engaged between the links of the link chain 40, movement of the traveller 12 by the user causes the link chain 40 to move in the same direction as the traveller 12. If chain coupler 64 is also in the engaged position, then movement of the traveller 12 by the user causes link chain 40 to move, thus causing the traveller 14 to move without additional force from the user. Similarly, with both chain couplers 62 and 64 engaged, movement of the traveller 14 by the user causes the traveller 12 to also move. Because the link chain 40 is in an endless oval arrangement, movement of traveller 12 toward the front of the apparatus causes the traveller 14 to move toward the back of the apparatus, and vice versa.

Actuating knob 32 on chain coupler 62 is used to release the traveller 12 from coupling with the link chain 40 in the manner described above.

When disengaged from the link chain 40, the traveller 12 may move freely in either direction within groove 11 of rail 10, regardless of the direction of movement of traveller 14. The lower actuating knob 38 operatively connected to chain coupler 64 performs a similar disengagement function for traveller 14.

It is to be understood that chain couplers 62' and 64' are similarly engaged and disengaged to link chain 50, thus affecting engagement of the traveller 22 and 24 to the link chain 50.

It is to be understood that chain couplers 62, 64, 62' and 64' are used for selectively releasing the respective travellers from the respective endless chain means.

Figure 8:
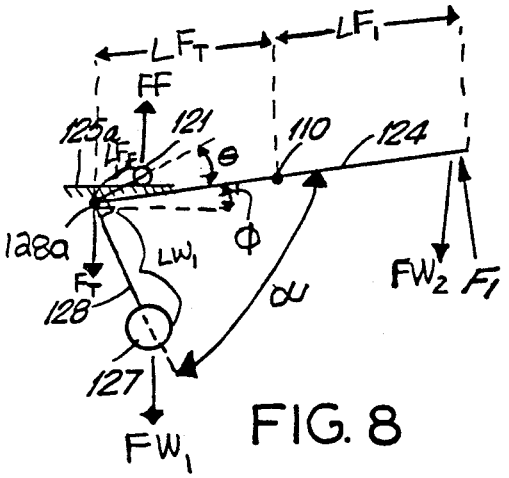
FIG. 8 is a schematic representation of the force resistance system of the apparatus wherein a breaking force exerted on a torque arm of the force resistance system is at a first level $F_1$.
Figure 9:
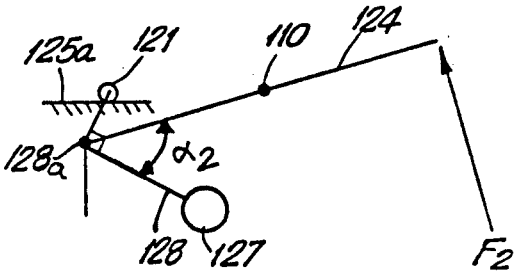
FIG. 9 is a schematic representation of the force resistance system of the apparatus wherein the torque exerted on the torque arm of the force resistance system is at a second level $F_2$.

Referring to FIGS. 1 and 11, a housing 1000 encloses a force resistance system at the rear of the apparatus 1. The force resistance system provides a resistance to the force exerted by the user during exercise. FIGS. 3, 4, 4A and 6 (discussed below) show the details of the preferred embodiment of the force resistance system. FIGS. 8 and 9 (also discussed below) provide a schematic representation of the system.

Figure 3:
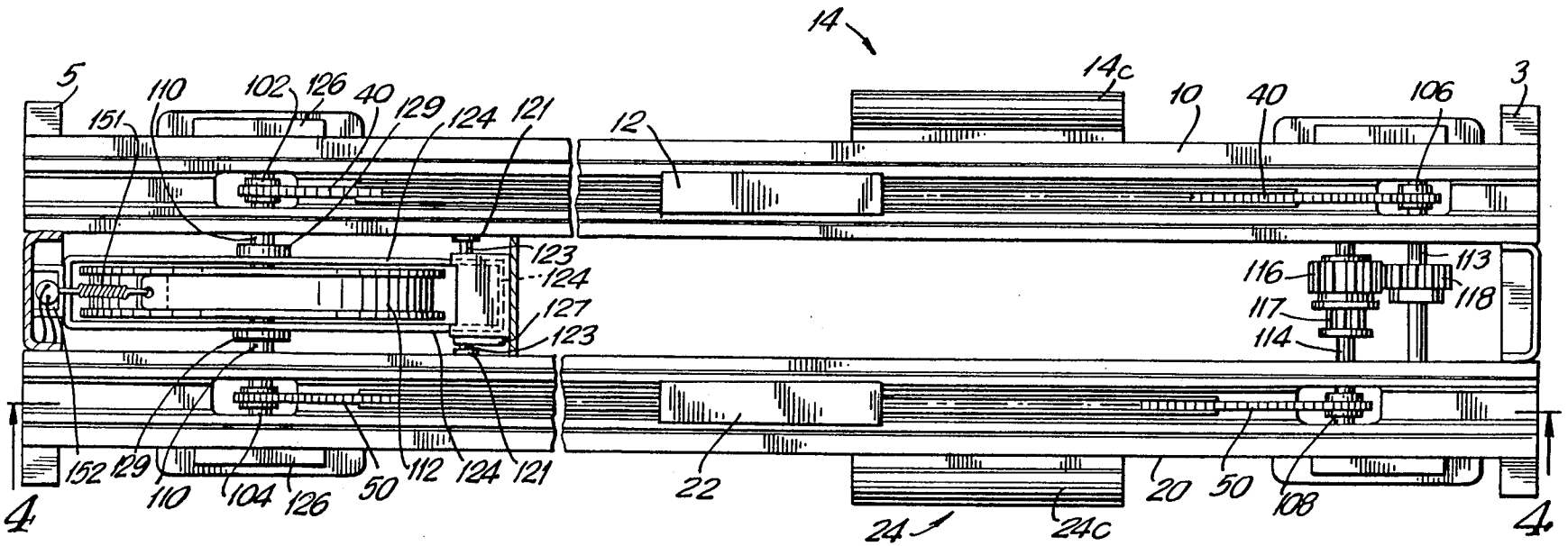
FIG. 3 is a top view of the apparatus of FIG. 1 with a cover section broken away to show details of a force resistance system and also to show details of a drive system for the apparatus wherein a first and second drive gears are engaged with one another to provide for opposite acting first and second endless chain means.
Figure 7:
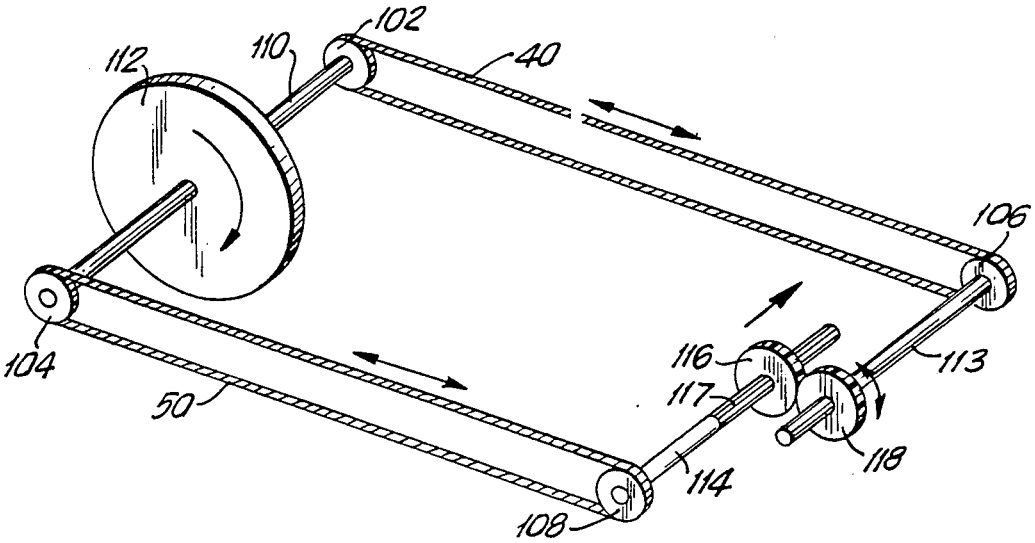
FIG. 7 is a simplified schematic view of the drive system of the apparatus of FIG. 1.

Reference should be made to FIGS. 3, 4 and 7 for details of the means for driving the link chains 40 and 50. Link chain 40 extends from the front end of the apparatus 1 at a sprocket 106 to the rear end of the apparatus 1 at a sprocket 102. Similarly, link chain 50 extends from sprocket 108 to sprocket 104, sprockets 106 and 108 being offset in relation to one another as best seen in FIG. 3. A cover plate 1100, shown in FIGS. 1 and 11, covers sprockets 106 and 108.

Sprockets 102 and 104 are supported on shaft 110 by bearing systems 126 and suitable pillow blocks in rails 10 and 20. Sprocket 106 is supported on shaft 113 and sprocket 108 is supported on shaft 114 by bearing systems and suitable pillow blocks in the rails 10 and 20.

Sprockets 102 and 104 are mounted on conventional overrunning clutches. The overrunning clutches lock in the same direction of rotation. Sprockets 102 and 104 act on shaft 110, which in turn drives a power resistance device, for example a flywheel 112. Chain links 40 and 50 drive sprockets 106 and 108, respectively. Sprockets 106 and 108 are geared to shafts 113 and 114, respectively, and therefore drive those shafts when sprockets 106 and 108 are driven by chain links 40 and 50.

A first drive gear 116 is mounted on splines 117 on shaft 114. A second drive gear 118 is mounted on shaft 113. When gears 116 and 118 are engaged with one another, as shown in FIG. 3 and schematically in FIG. 7, the shafts 114 and 113 cause the motion of link chains 50 and 40 to be opposite acting. Opposite acting link chains are required for a quadrilateral recumbent exercise and a cross-country ski trainer where the left arm and the right arm and the left leg and the right leg move in opposite directions relative to one another during the exercise.

Figure 4A:
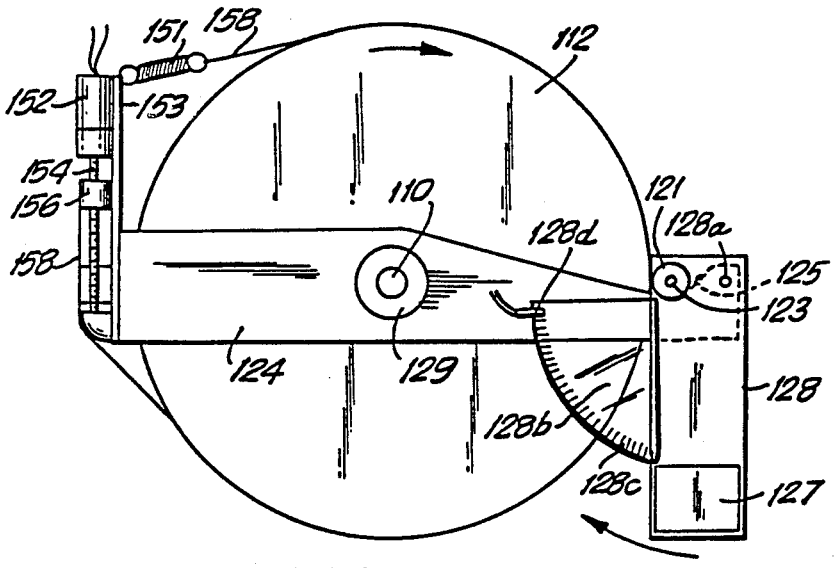
FIG. 4A is a detail view in isolation of the force resistance system shown in part in FIGS. 3 and 4.

Therefore, as the user oscillates the chain means 40 and 50, for example through the application of force on pedals 80 or handles 90 shown in FIG. 11, this causes shaft 110 and flywheel 112 to rotate only in one direction as shown by the arrow on the flywheel 112 in FIGS. 4, 4A and 7. The overrunning clutches on shaft 110 prevent rotation of the shaft 110 and the flywheel 112 in any direction except that indicated by the arrow on the flywheel 112 in FIGS. 4, 4A and 7.

If the apparatus of FIG. 11 is configured such that gears 116 and 118 are engaged with one another, and travellers 12 and 22 are coupled to the link chains 40 and 50, respectively, then oscillating motion applied by the user to the foot pedals 80 will result in a resistive force from the flywheel 112 in both directions of oscillation, due to action of the overrunning clutches. The force resistance system, shown in detail in FIGS. 3, 4, 4A and 6 and schematically in FIGS. 8 and 9, determines the amount of resistive force the user will encounter during the oscillation of the pedals 80.

The simplified drive system in FIG. 7 is less expensive and has fewer parts compared to prior drive systems, and it allows the use of internally mounted chains and travellers which further reduces cost and complexity.

For recumbent exercise, the apparatus 1 configured as shown in FIG. 11, may be used. Pedals 80 are attached to the top travellers 12 and 22 and handles 90 are attached to the bottom travellers 14 and 24. Seat 85, having a back portion and a seat cushion, is fixed at a position toward the rear of the apparatus. The pedals 80 are placed on travellers 12 and 22, and are shown in an upright position in FIG. 11 to provide foot support for the user. Each pedal may include a strap to restrain the user's feet.

The user exerts a force on pedals 80, driving the link chains 40 and 50. If the link chains 40 and 50 are connected to be opposite acting (i.e. gears 116 and 118 are engaged with one another), and all four travellers are coupled to their respective link chains, then the left leg of the user will move in the opposite direction to the movement of the right leg during the exercise, replicating a bicycle-like pedaling motion. The handles 90 will provide arm exercise, where the motion of the handles 90 will also be opposite acting. The user will encounter resistance during each motion stroke.

Figure 10:
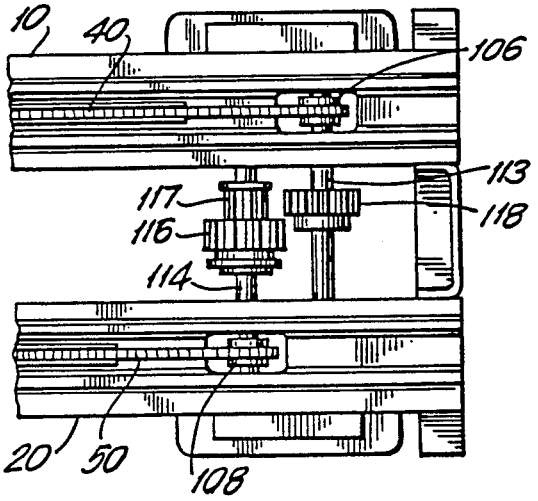
FIG. 10 is a top view of the front portion of the apparatus of FIG. 1 with the cover broken wherein the first and second drive gears are not engaged and thus the first and second endless chain means are not opposite acting.

If it is desired to use the apparatus in a rowing mode where the two handles 90 are not opposite acting, drive gear 116 is disengaged from gear 118 by sliding gear 116 on splines 117 to the position shown in FIG. 10. The link chains 40 and 50 are thereby not forced to be opposite acting and the chains 40 and 50 simultaneously drive the shaft 110 through the sprockets 102 and 104. In the rowing mode the pedals 80 may be attached directly to the rails at a fixed position and the seat slidably mounted to the rails to provide a more realistic rowing exercise. In the rowing mode, the handles 90 move synchronously.

It is readily seen that any number of exercise modes are possible with the apparatus, depending on how many travellers are coupled to the link chains and also depending on whether gears 116 and 118 are engaged with one another.

A control console 1200 shown in FIG. 11 is operatively connected to the mechanical components of the apparatus 1. A microprocessor in the console 1200 can be programmed to provide information on a display concerning the operational parameters of the apparatus, for example, the distance travelled by the link chains, speed, stroke rate, etc. The console 1200 may also be used to vary the resistance encountered by the user from a force resistance system.

Figure 16:
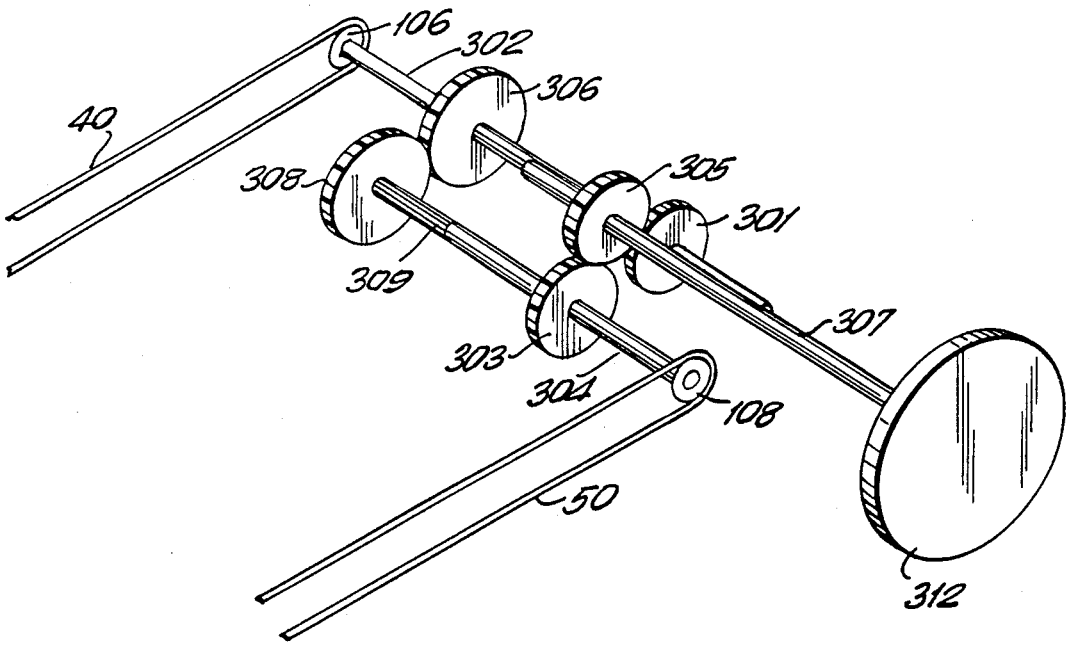
FIG. 16 is a schematic representation of an alternate drive system to the drive system shown in FIG. 7 for the exercise apparatus.

FIG. 16 shows an alternate drive system to that shown in FIG. 7. Sprockets 106 and 108 are locked to shafts 302 and 304, respectively. Gears 306 and 308 are coupled to shafts 302 and 304, respectively, and force the motion of link chains 40 and 50 to be opposite acting when the gears 306 and 308 are engaged. Gears 301 and 303 are mounted to shafts 302 and 304, respectively, through conventional overrunning clutches. The overrunning clutches both lock in the same direction of rotation. Gear 305 engages gears 301 and 303, and drives shaft 307 and the resistance device, such as flywheel 312. As the chains 40 and 50 are oscillated by the user, they alternately drive gears 301 and 303 which causes the continuous rotation of gear 305, shaft 307 and flywheel 312.

Gear 308 is coupled to shaft 304 through splines 309. Therefore, gear 308 can be moved axially along shaft 304 and disengaged from gear 306. When this is done, the chains 40 and 50 are no longer forced to be opposite acting. Rather, they can move in unison and simultaneously drive shafts 302 and 304. This motion is required for the rowing mode.

FIG. 8 is a schematic representation of a force resistance system shown in detail in FIGS. 3, 4, 4A and 6.

In FIG. 8, a braking force $F_1$ is applied to a first end of a torque arm 124. Torque arm 124 rotates around a first pivot point 110. A secondary arm 128 at a first end is mounted to a second end of the torque arm 124 at a second pivot point **128*a*. The secondary arm 128 has a right angle configuration to a roller 121 which is mounted to the first end of the secondary arm 128. The roller 121 acts as a follower which moves along a fixed surfact 125*a* as the secondary arm 128 pivots, as described below. A weight 127 is mounted to a second end of the secondary arm 128**.

The force $F_1$ causes the torque arm 124 to be displaced, thus generating a torque ($F_1$* $LF_1$), where $LF_1$ is the distance between the point of the application of the force $F_1$ on arm 124 and the pivot point 110.

The pivoting of the torque arm 124 around pivot point 110 causes the angular displacement of the secondary arm 128 as roller 121 moves along the fixed surface 125*a*, i.e., the roller 121 acts as a follower. The secondary arm 128 pivots at pivot point 128*a*. The displacement of the secondary arm 128 and the weight 127 generates a torque which counteracts the torque generated by force $F_1$. The counteracting torque is generated by a tangential force $F_T$ at pivot point 128*a*, the counteracting torque equaling ($F_T$ * $LF_T$), where $LF_T$ is the distance between the application point of the force $F_T$ and the pivot point 110. The tangential force $F_T$ equals $(FF-FW_1) * \cos\phi$, where FF equals the vertical force on the follower 121, $FW_1$ equals the force of gravity of weight 127 and secondary arm 128, and the angle $\phi$ is the angle between the torque arm 124 and the horizontal, as shown in FIG. 8. Once the system reaches equilibrium, i.e. once the torques ($F_1$ * $LF_1$) and ($F_T$* $LF_T$) equal one another, and the secondary arm 128 ceases to pivot (which will generally take about two to three seconds in the preferred embodiment), the angle $\alpha$ in FIG. 8 will be directly related to the braking force $F_1$ through a trigonometric function, where $\alpha$ is the angle between the secondary arm 128 and the torque arm 124. Specifically, the braking force $F_1$ equals $$F_1 = \left(\frac{LF_T}{LF_1} * FW_1 * \frac{LW_1}{LF_F} * \tan(\theta + \Phi) - \frac{LF_T}{LF_1} * FW_1 + FW_2\right) * \cos\Phi \quad (1)$$

where the variables referenced in the equation are as follows:

$LF_T$ is the distance between the pivot of application of the tangential force $F_T$ and the pivot point 110;

$LF_1$ is the distance between the point of application of the braking force $F_1$ and the pivot point 110;

$LW_1$ is the length of the secondary arm;

$LF_F$ is the distance from the pivot point 128*a* to the follower 121;

$FW_1$ is the force due to gravity for the weight 127 and the secondary arm 128;

$\theta$ is the angle between the roller 121 and the torque arm 124;

$\phi$ is the angle between the torque arm 124 and the horizontal axis; and $FW_2$ is the force due to gravity of the brake system mounted at the first end of the torque arm 124 and the torque arm itself.

Since the angle $\phi$ is, in the present embodiment, never more than 10 degrees, its influence on equation (1) is minor and therefore equation (1) may be simplified to:

$$F_1 = \frac{LF_T}{LF_1} * FW_1 * \frac{LW_1}{LF_F} * \tan\theta - \frac{LF_T}{LF_1} * FW_1 + FW_2 \quad (2)$$

The angle $\alpha$, which is the angle between the secondary arm 128 and the torque arm 124, is related to the angle $\theta$ in the following manner:

$$\theta = 90 - \alpha \quad (3)$$

Substituting the value for $\theta$ from equation (3) into equation (2), and recognizing that $\tan(90-\alpha) = \text{cotan}\,\alpha$, results in:

$$F_1 = \frac{LF_T}{LF_1} * FW_1 * \frac{LW_1}{LF_F} * \text{cotan}\,\alpha - \frac{LF_T}{LF_1} * FW_1 + FW_2 \quad (4)$$

Therefore, it is seen that the braking force $F_1$ is directly related to the angle $\alpha$ and each angle $\alpha$ will have a unique braking force associated with it.

As explained below, provision is made to measure the angle $\alpha$ in a simple and accurate fashion, so that the braking force $F_1$ can be determined.

It is to be understood that the force arrows $F_1$, $FW_1$, etc. are not drawn to scale in FIG. 8.

FIG. 9 shows the same system schematically as FIG. 8, but with a greater braking force $F_2$ applied to the first end of torque arm 124. Because force $F_2$ is now greater, the angular displacement of secondary arm 128 increases, roller 121 moves further to the left on fixed surface 125*a* thus creating a greater counteraction force through the increased displacement of weight 127. Force $F_2$ is related to angle $\alpha_2$ through the same trigonometric function described above in relation to FIG. 8.

The details of the preferred embodiment of the force resistance system are shown in FIGS. 3, 4, 4A and 6. The flywheel 112 is mounted on the shaft 110 which is suspended by the bearing system 126 (seen in FIG. 2) from the rails 10 and 20. The torque arm 124, which for example is bent sheet metal, rotates about the shaft 110 by means of bearings 129. The shaft 110 is schematically represented as the first pivot point 110 in FIG. 8. The secondary arm 128, which also for example is bent sheet metal, is mounted on and rotates about the shaft 128*a*. The shaft 128*a* is schematically represented as the second pivot point 128*a* in FIG. 8.

The rollers 121 are mounted to the secondary arm 128 by shaft 123. The rollers 121 roll within grooves 125 in rails 10 and 20. In FIG. 8, the grooves 125 are schematically represented as a flat surface 125*a*. Since the rollers 121 are mounted to the secondary arm 128, the secondary arm 128 will pivot upwardly in the direction of the arrow in the lower right on FIG. 4A as the rollers move along grooves 125 in response to the upward pivoting of the secondary arm 128.

Figure 6:
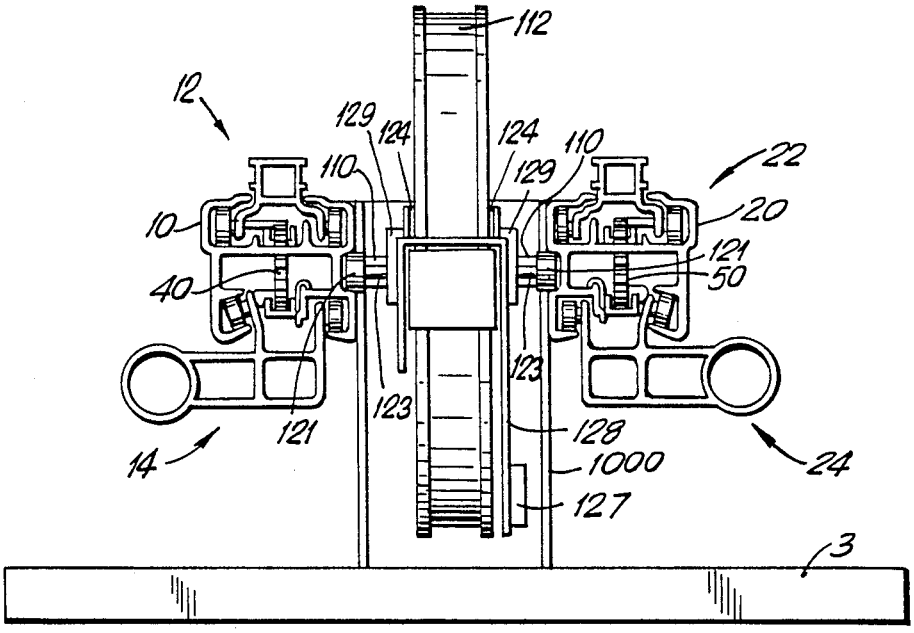
FIG. 6 is a simplified elevational view in section along lines 6—6 of FIG. 4 showing additional details of the force resistance system.

It is understood that there are two torque arms 124, one on each side of the flywheel 112, and that rollers 121 are located in grooves 125 for both rails 10 and 20, and that the rollers 121 are mounted to the secondary arm 128 by shaft 123, as best seen in FIGS. 3 and 6. The mounting of the rollers 121 to the secondary arm 128 is schematically represented in FIG. 8 by the line between pivot point 128*a* and the roller 121.

The weight 127 is mounted on the secondary arm 128. A clear plastic scale 128*b* is also mounted to the secondary arm 128 by adhesive or the like. The plastic scale 128*b* is marked at its edge with black segments 128*c* which are detected by optical interrupters 128*d*. A potentiometer could also be used in place of the optical interrupters 128*d*. The signals from interrupters 128*d*, when processed by logic circuitry, such as in a microprocessor in the control console 1200 shown in FIG. 11, indicate the angle $\alpha$ between the secondary arm 128 and the torque arm 124 (shown on FIGS. 8 and 9), which is proportional to the braking force, as described above.

Thus, the braking force can be easily determined from a measurement of the angle $\alpha$.

In the present embodiment, a brake system consists of a motor 152 which drives lead screw 154, which causes the movement of a threaded block 156 which is threaded on the lead screw 154. Movement of the threated block 156 tensions brake belt 158 which is attached at one end to the threaded block 156. Brake belt 158, which, for example, is a conventional nylon brake belt, wraps around a groove on the outer circumference of the flywheel 112 and terminates at spring 151. The spring 151 is attached to a chassis 153 on which motor 152 is mounted.

The basic operation of the force resistance system is as follows. The motor 152 tensions the brake belt 158 thereby generating a force (such as force $F_1$ in FIG. 8) in the torque arm 124 thereby causing torque arm displacement. As the torque arm 124 displaces, it causes the displacement of the secondary arm 128 and the weight 127 which creates a torque that counteracts the torque due to the braking force, as described above. Once the system reaches equilibrium, i.e., the two torques equal one another and the secondary arm ceases to pivot upwardly, the angle $\alpha$, which is the angle between the secondary arm 128 and the torque arm 124, is sensed by the optical interrupters **128*d***. As described above, the angle $\alpha$ is related to the braking force.

By utilizing control signals to the motor 152 from, for example, a microprocessor in the control console 1200, the motor 152 can tension the brake belt 158 incrementally until the braking force reaches a level programmed by the microprocessor. For instance, as the brake belt is further tensioned, the braking force $F_1$ (FIG. 8) will increase to a higher value such as $F_2$ (FIG. 9).

Since the link chains 40 and 50 are connected to the force resistance system through the shaft 110 and sprockets 102 and 104, as shown schematically in FIG. 7 and discussed above, the user will encounter the programmed braking force when moving the link chains 40 or 50 via the handles and pedals mounted to the travellers 12, 22, 14 and 24. The user must overcome this braking force in order to rotate the flywheel 112. Therefore, as the user exerts a force to turn the flywheel 112, the user encounters a constant predetermined resistance to his exercise motion.

The force resistance system described above has a number of advantages over prior systems. First, this system is quite compact and fits easily between the rails 10 and 20. Second, it is inexpensive as it utilizes only stamped parts, a light-duty dc motor 154, and a standard, low cost position sensor, for example potentiometers or optical interrupters **128*d*. Third, the system moves with the flywheel 112 and the shaft 110 which is important because the flywheel 112 and the shaft 110 must on occasion be positionally adjusted to eliminate slack in link chains 40 and 50. Fourth, this system can be made very accurate with properly designed bearings at the pivot points 110 and 128*a*, and with sufficient accuracy and resolution in the potentiometers or optical interrupters 128*d***. Finally, the system can detect a wide range of braking forces. This allows the system to be programmed for a wide-range of exercise intensities. At small forces, the force resistance system, by virtue of its geometry, is very sensitive. Yet it is capable of detecting forces up to the yield strength of the transducer components.

It is readily seen that the force resistance system described above may be used on any sort of exercise or physical therapy apparatus, where it is desired to provide a predetermined resistive force to any force exerted by a user of the apparatus. For example, the force resistance system described above may be used on a quadrilateral recumbent exerciser, a rowing machine, ski trainer, upper body ergometer, stationary pedal exercise bicycle, and on any apparatus requiring a set resistive force.

FIG. 12 shows a way of adjusting the position of the handles 90 or the pedals 80 relative to the travellers 12, 14, 22 and 24. Adjusting the position of the handles 90 or the pedals 80 relative to the travellers is not necessary where selective coupling of the travellers to the link chains is used, because selective coupling allows the user to position the traveller and attached pedal or handle at any point along the link chain. Selective coupling is shown in FIGS. 2, 5A and 5B, and is described above.

However, to cut down on the expense of the apparatus, it may be desirable to eliminate the means for selectively coupling the travellers to the link chains, for example the levers, links and actuating knobs shown above in FIGS. 5A and 5B. This simpler and less expensive apparatus has the travellers permanently coupled to the link chains, for instance by rivets or bolts.

However, for an apparatus having permanently coupled travellers, it is necessary to have selective positioning of the pedals and handles relative to the travellers in order to accommodate users having limbs of different sizes. One manner of selectively positioning the travellers to the link chains is shown in FIG. 12. In this embodiment, pedal 80 is positioned on traveller 12 by sliding the pedal 80 on the traveller 12 to the desired relative position and then fixing the pedal 80 in that position using a spring-loaded pull pin 82 which engages in pin holes 84 in traveller 12. Similarly, the radial receiving portion **14*c* of traveller 14 if fixed at the desired position with spring-loaded pull pin 92 which engages pin holes 94 in traveller 14**.

In order to selectively position the handle 90 or the pedal 80, the pull pins 82 or 92 are disengaged from the holes 84 or 94, the pedal 80 or the handle 90 is repositioned, and the pull pins 82 or 92 are reengaged.

As is readily understood from the above description, selective positioning of the pedals 80 and handles 90 on the travellers is not related in any way to selective coupling of the travellers to the link chains 40 and 50.

Figure 14:
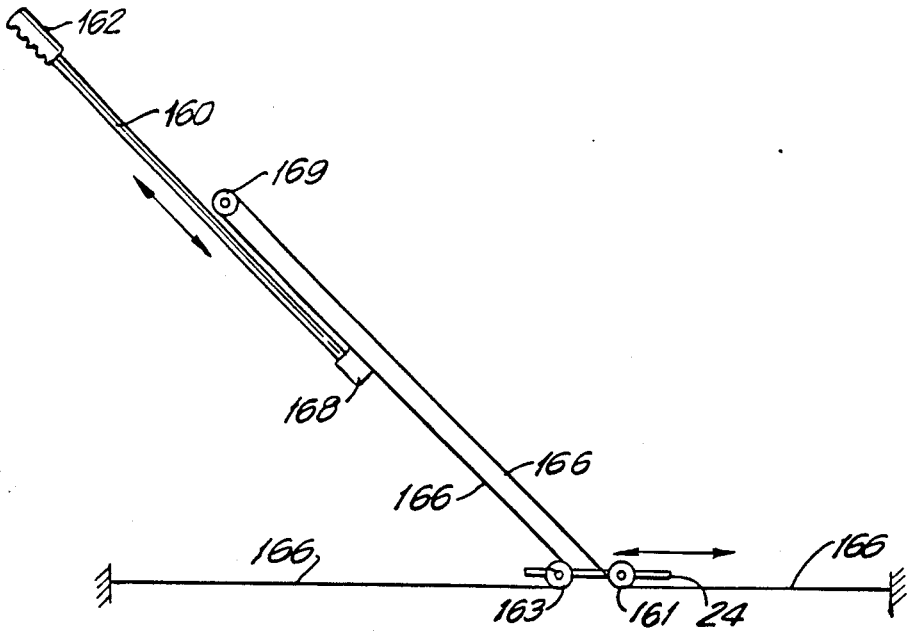
FIG. 14 is a schematic representation of the operation of the telescoping ski poles shown in FIG. 13.
Figure 15:
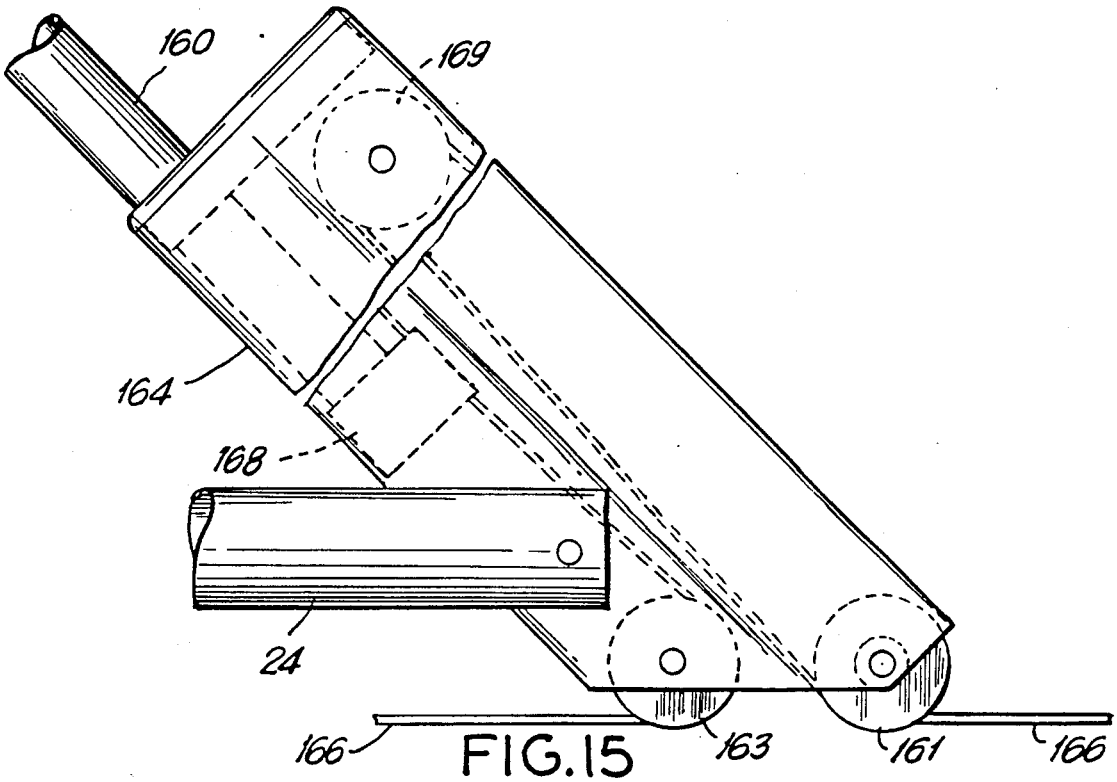
FIG. 15 is a detail view, partly in section, of the telescoping structure on the ski poles shown in FIG. 13.

A ski trainer with telescoping ski poles is shown in FIGS. 13–15. Pedals 80, which are laid flat as footplates to simulate skis, reciprocate under power from the user, and the user, standing erect, grasps handle 162 of ski poles 160 and simulates a cross-country skiing motion. FIG. 14 is a schematic representation of the operation of the ski pole system in FIG. 13, and FIG. 15 is a detailed section view of various parts of the system.

Ski pole handle 162 is attached to pole 160, which in turn telescopes into pole base 164. Line 166 is attached to the apparatus at the front and rear, and is routed up and down the pole system by means of pulleys 161, 163 and 169. Pole 160 is attached to line 166 by means of a knot at slider 168.

As a downward force is applied by the user to the ski pole handle 162, a tension is created in line 166 that generates a thrust in traveller 24. The handle motion has two components, a forward motion of the traveller 24, and the telescoping motion of the pole 160 out of pole base 164 due to the sliding action of slider 168 in the pole base 164. The sum of these two components results in a long handle motion that closely approximates the arm motion of cross country skiing.

It is to be understood that for the ski trainer a telescoping ski pole arrangement identical to that shown in FIGS. 13–18 is also provided for traveller 14, and a pedal on traveller 12 is used to simulate a ski during the ski exercise.

Figure 17:
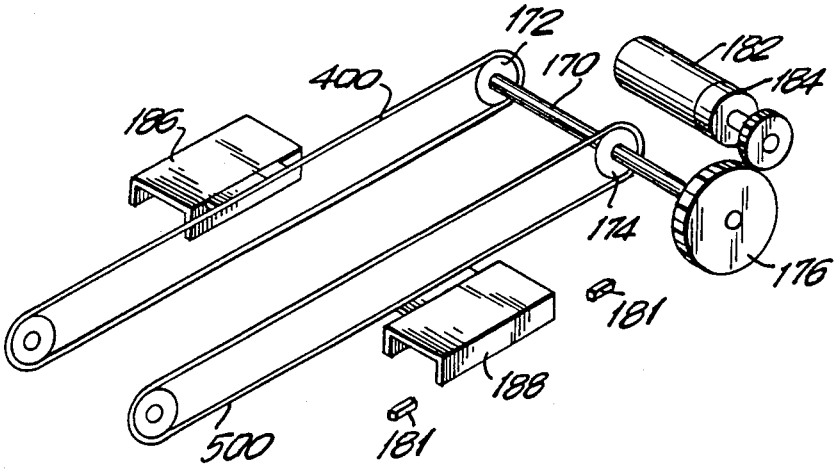
FIG. 17 is a schematic representation of a motor drive system for the exercise apparatus where the user's limbs are driven through the exercise by a motor.

FIG. 17 shows a motor drive system for the apparatus 1, where the limbs of the user are passively carried through the exercise by the travellers. Physical therapy applications often require motor drive. Shown schematically in FIG. 17 is one way to accomplish this motor drive. Traveller 186 is selectively coupled to link chain 400 and traveller 188 is selectively coupled to link chain 500. Sprockets 172 and 174 and gear 176 are fixed to shaft 170. Reversing motor 182 driving through slip clutch 184 and gear 176 causes the oscillating motion of link chains 400 and 500. The slip clutch 184 is set at a sufficiently low torque level to prevent injury to the patient should a mechanical or electrical malfunction occur. Limit switches 181 can be selectively positioned so as to control stroke length and location. As traveller 186 activates limit switches 181, the direction of the motor 182 is reversed, causing the oscillating motion of travellers 186 and 188.

It is understood that my invention is not limited to the embodiments described above, but is defined by the following claims.

I claim:

1. An improved exercise apparatus for use in exercising one or more of the limbs of a user comprising:

a generally horizontally rail mounted on a supportive frame of the apparatus;

a first and second traveller mounted on the rail, the first traveller and the second traveller adapted to engage the limbs of the user during exercise, the first traveller and the second traveller being supported on the rail one above the other for movement in opposite relative directions;

endless chain means deployed in a loop;

first means for coupling the first traveller to the endless chain means;

second means for coupling the second traveller to the endless chain means;

force resisting means; and means for connecting the endless chain means to the force resisting means wherein the user of the apparatus encounters resistance from the force resisting means when the user applies a force to the first traveller.

2. The apparatus of claim 1 also comprising first releasing means for selectively releasing the first traveller from the endless chain means and second releasing means for selectively releasing the second traveller from the endless chain means.

3. The apparatus of claim 1 also including drive means for driving the endless chain means without the user exerting a force on any of the travellers.

4. The apparatus of claim 1 including a second rail mounted on the supportive frame of the apparatus and a third and fourth traveller mounted on the second rail, further including a first ski pole having a first base attached to the second traveller and a second ski pole having a second base attached to the fourth traveller where in the user engages in ski exercise.

5. The apparatus of claim 4, including a first handle telescoped within the first base and a second handle telescoped within the second base, said handles moving in a telescoping fashion within said bases, resulting in hand stroke movement, when the user engages in ski exercise.

6. The apparatus of claim 1 including a first drive gear operatively connected to a first endless chain means and a second drive gear operatively connected to a second endless chain means, and means for engaging the first drive gear with the second drive gear, wherein the first and second endless chain means are opposite acting when the first and second drive gears are engaged with one another and the user exerts a force on the first traveller.

7. The apparatus of claim 6 including means to disengage the first drive gear from the second drive gear wherein the first endless chain means and the second endless chain means are driven synchronously when the first and second drive gears are disengaged and the user exerts a force on the first traveller.

8. The apparatus of claim 1 including first means for selectively positioning a first limb engaging means on the first traveller and a second means for selectively positioning a second limb engaging means on the second traveller.

9. An improved exercise apparatus for use in exercising one or more of the limbs of a user comprising:

a first rail mounted on a supportive frame of the apparatus;

a second rail mounted on the supportive frame of the apparatus;

a first traveller supported internally to the first rail, a second traveller supported internally to the first rail, a third traveller supported internally to the second rail and a fourth traveller supported internally to the second rail, the first, second, third and fourth traveller adapted to engage the four limbs of the user during exercise;

wherein a top portion of the first traveller extends upwardly out of a top opening of the first rail, a bottom portion of the second traveller extends downwardly out of a bottom opening of the first rail, a top portion of the third traveller extends upwardly out of a top opening of the second rail and a bottom portion of the fourth traveller extends downwardly out of a bottom opening of the second rail, the top portion of the first traveller adapted to receive a first limb engaging means, the bottom portion of the second traveller adapted to receive a second limb engaging means, the top portion of the third traveller adapted to receive a third limb engaging means and the bottom portion of the fourth traveller adapted to receive a fourth limb engaging means, first endless chain means deployed in a loop and supported about the first rail;

second endless chain means deployed in a loop and supported about the second rail;

first means for coupling the first traveller to the first endless chain means;

second means for coupling the second traveller to the first endless chain means;

third means for coupling the third traveller to the second endless chain means;

fourth means for coupling the fourth traveller to the second endless chain means;

force resisting means; and means for connecting the first and second endless chain means to the force resisting means wherein the user of the apparatus encounters resistance from the force resisting means when the user applies a force to the first traveller.

10. The apparatus of claim 9 wherein the bottom portion of the second traveller extends laterally beyond a side edge of the first rail and the bottom portion of the fourth traveller extends laterally beyond a side of the second rail.

11. The apparatus of claim 9 also including a first drive gear operatively connected to the first endless chain means and a second drive gear operatively connected to the second endless chain means, and means for engaging the first drive gear with the second drive gear, wherein the first and second endless chain means are opposite acting when the first and second drive gears are engaged with one another and the user exerts a force on the first traveller.

12. The apparatus of claim 11 also including means to disengage the first drive gear from the second drive gear wherein the first endless chain means and the second endless chain means are driven synchronously when the first and second drive gears are disengaged and the user exerts a force on the first traveller.

13. The apparatus of claim 9 also including a seat for supporting the user when engaged in a recumbent or rowing exercise.

14. The apparatus of claim 9 also including first releasing means for selectively releasing the first traveller from the first endless chain means, second releasing means for selectively releasing the second traveller from the first endless chain means, third releasing means for selectively releasing the third traveller from the second endless chain means and fourth releasing means for selectively releasing the fourth traveller from the second endless chain means.

15. The apparatus of claim 9 also comprising power drive means for driving the first endless chain means and the second endless chain means without the user exerting a force on any of the travellers.

16. The apparatus of claim 9 also comprising a first ski pole having a first base attached to the second traveller and a second ski pole having a second base attached to the fourth traveller wherein the user engages in ski exercise.

17. The apparatus of claim 16 also comprising a first handle telescoped within the first base and a second handle telescoped within the second base, said handles moving in a telescoping fashion within said bases, resulting in hand stroke movement, when the user engages in ski exercise.

18. The apparatus of claim 9 wherein the first and second rails are mounted on the supportive frame in parallel relation.

19. The apparatus of claim 9 also comprising a microprocessor-control console operatively connected to the force resisting means for measuring the force exerted by the user during exercise.

20. An improved exercise apparatus for use in exercising one or more of the limbs of a user comprising:

a generally horizontally rail mounted on a supportive frame of the apparatus;

a first traveller supported internally to the rail and a second traveller supported internally to the rail, the first traveller and the second traveller adapted to engage the limbs of the user during exercise, the first traveller and the second traveller being supported internally to the rail one above the other for movement in opposite relative directions;

wherein a top portion of the first traveller extends upwardly out of a top opening of the rail and a bottom portion of the second traveller extends downwardly out of a bottom opening of the rail, the top portion of the first traveller adapted to receive a first limb engaging means and the bottom portion of the second traveller adapted to receive a second limb engaging means;

endless chain means deployed in a loop;

first means for coupling the first traveller to the endless chain means;

second means for coupling the second traveller to the endless chain means;

force resisting means; and means for connecting the endless chain means to the force resisting means wherein the user of the apparatus encounters resistance from the force resisting means when the user applies a force to the first traveller.

21. The apparatus of claim 20 wherein the bottom portion of the second traveller extends laterally beyond a side edge of the rail.

22. The apparatus of claim 20 wherein the bottom portion of the second traveller extends laterally beyond a side edge of the rail and terminates in a radial receiving portion adapted to receive the second limb engaging means.

23. The apparatus of claim 20 wherein a downwardly-extending side wall of the first traveller is attached to first rolling means, the first rolling means adapted to be received in a top groove in the rail, and wherein an upwardly-extending side wall of the second traveller is attached to second rolling means, the second rolling means adapted to be received in a bottom groove in the rail.

24. The apparatus of claim 23 wherein the upwardly-extending side wall of the second traveller is angled to be linear to a point on the second limb engaging means which the user graps during the exercise.

25. The apparatus of claim 23 also comprising slide blocks located within the top and bottom grooves and attached to the travellers to prevent lateral shifting of the first traveller and the second traveller.

26. The apparatus of claim 20 also comprising first means for selectively positioning the first limb engaging means on the first traveller and second means for selectively positioning the second limb engaging means on the second traveller.

27. The apparatus of claim 20 including a first drive gear operatively connected to a first endless chain means and a second drive gear operatively connected to a second endless chain means, and means for engaging the first drive gear with the second drive gear, wherein the first and second endless chain means are opposite acting when the first and second drive gears are engaged with one another and the user exerts a force on the first traveller.

28. The apparatus of claim 27 including means to disengage the first drive gear from the second drive gear wherein the first endless chain means and the second endless chain means are driven synchronously when the first and second drive gears are disengaged and the user exerts a force on the first traveller.

* * * * *